United States Patent [19]

Goldman, Jr.

[11] Patent Number: 4,840,093

[45] Date of Patent: Jun. 20, 1989

[54] LID LOOSENER AND TIGHTENER

[76] Inventor: Leman Goldman, Jr., 2644 Rockafellow Ave., Pennsauken, N.J. 08109

[21] Appl. No.: 133,651

[22] Filed: Dec. 16, 1987

[51] Int. Cl.[4] ..... B67B 7/18

[52] U.S. Cl. ..... 81/3.43; 81/64

[58] Field of Search ..... 81/3.43, 64, 3.4

[56] References Cited

U.S. PATENT DOCUMENTS

| | | | |
|---|---|---|---|
| 635,049 | 10/1899 | Look | 81/3.43 |
| 2,057,949 | 10/1936 | Hodson | 81/3.43 |
| 2,132,207 | 10/1938 | Donovan | 81/3.43 |
| 3,678,788 | 7/1972 | Matti | 81/3.43 |

*Primary Examiner*—Debra Meislin

[57] ABSTRACT

A device for loosening and tightening the lids on jars or containers. The device has a handle, and a strap and brace attached to the handle. The strap is placed through the brace and formed into a loop so that it may be slipped over the lid. When a rotational force is applied to the handle, the brace pulls against the strap so as to apply a rotational force to the lid which is greater than the force applied to the handle. A spike extends from the top of the device which is placed through a hole in the strap to secure the strap to the handle. The strap has a series of holes to accommodate a large variation in sizes of lids. For loosening the lid, a counterclockwise force, relative to the center of the lid when viewed from above, is applied to the handle. For tightening the lid, the handle is reversed and a clockwise force is applied to the handle. For infirm users who have arthritic hands and cannot grasp lids or containers, two devices may be used, with one strap placed around the lid and the other around the jar or container. The lids can be loosened or tightened by pushing against the handles rather than grasping them.

6 Claims, 2 Drawing Sheets

LID LOOSENER AND TIGHTENER

BACKGROUND OF THE INVENTION

This invention relates to devices for loosening and tightening the lids on jars.

Loosening and removing jar lids is sometimes very difficult. Jars are often vacuum packed and the lids are tightened by mechanical means. This increases the amount of rotational force required to loosen the lids to remove the contents of the jars. Further, at times, the contents of the jars are viscous, so that the contents harden between the surface at the top of the jar and the inner surfaces of the lid. This condition often occurs with heavy, tacky materials such as honey or molasses, as well as other foods which can dry up.

People with reduced strength including children, the elderly, women and the ill and infirm sometimes require assistence to loosen and remove the lids on jars. Even strong individuals sometimes require help when lids are held fast by dried materials or when the lids have been strongly tightened by mechanical means at the factory. Further, persons with arthritic hands can neither grip the jar or the lid, so that even devices to assist in the loosening of lids are not helpful if the lid or jar be must gripped and held fast.

In addition to loosening the lids on jars to obtain the contents of the jars, it is often desireable to securely tighten the lids. Tightly closing containers with volatile materials is often required to prevent evaporation or the escape of noxious odors. Also, certain materials may be contaminated by oxygen or other outside elements if the jars or containers which are holding the materials are not tightly closed.

Existing devices to loosen lids on jars include those which have a circumferential section geared to a centrally located handle. The device is held above the lid to be loosened with the circumferential section of the device positioned outside of the circumferential rim of the lid. As the handle is rotated counter-clockwise the gearing causes the circumferential section of the device to tighten about the rim of the lid. Further counter-clockwise rotation of the handle while the jar is held tends to rotate the lid counter-clockwise and loosen the lid. The mechanical advantage created by the device, i.e. the force applied to the lid is greater than that applied to the handle, assists the user in loosening the lid. This type of device is fairly expensive to manufacture. It cannot be used to tighten lids and can only be applied to a limited range of lid sizes.

Another lid loosening device is installed under a counter top. The lid of the jar is slid into the device with the lid between a gnurled knob protruding downward from the surface of the device and an arcuate rim on the device. When the jar is grasped and turned, the device acts like a vise and the lid to loosened. However, the lid cannot be tightened by use of the device.

Matti, in U.S. Pat. No. 3,678,788 discloses a container top opener which comprises a looped strap connected near one end of a handle. When the the strap is placed around a lid adjacent the near end of the handle a larger lid may be loosened by rotating the handle about a fulcrum at the near end. When the strap is looped about a lid at the far end of the handle a smaller lid may loosened. The use of two devices, one with strap about the lid and the other with strap about the container is also disclosed.

This device, although useful for loosening lids of jars, has several shortcomings. First, the range of lid sizes and container sizes which can handle by the device is limited, because the strap loop is of fixed length. Further, the device is difficult to use. One hand must grasp the handle while the other holds the strap about the lid. After the slack in the strap is taken up by rotating the handle, the hand holding the strap is slipped down to grasp the jar and the handle may then be rotated further to loosen the lid. Although the use of two devices is disclosed, this would be difficult, if not impossible, to do, with people of ordinary dexterity. Also, for small metal lids, the strap inner surface generally slips rather than hold firmly to the lid.

OBJECTS OF THE INVENTION

It is the general object of the instant invention to provide a device for loosening and tightening the lids on jars and containers which overcomes the deficiencies of existing devices.

It is a further object of the instant invention to provide a device which both loosens and tightens the lids on jars and containers.

It is a still further object of the instant invention to provide a device for loosening and tightening the lids on jars and containers which is simple and easy to use.

It is a still yet a further object of the instant invention to provide a device for loosening and tightening the lids on jars and containers which is easy and simple and inexpensive to manufacture.

It is another object of the instant invention to provide a device for loosening and tightening the lids on jars and containers which can be used with a wide range of sizes of lids and jars and containers.

It is yet another object of the instant invention to provide a system with two devices for loosening and tightening the lids on jars and containers, one such device to grasp the lid and the other such device to grasp the jar or container, which is easy to use.

It is still yet another object of the instant invention to provide a system with two devices for loosening and tightening the lids on jars and containers which allows the users with arthritic hands to push rather than grasp the devices.

SUMMARY OF THE INVENTION

These and other objects of the instant invention are achieved by providing a device comprising a handle, a strap, a brace and a spike. The strap has a wide section with a slot which is attached to the handle and a longer, narrow section with holes.

To loosen the lid of a jar or container, the top side of the device is positioned alongside the lid, facing away from the user. The loose unattached narrow section of the strap is placed through the brace, which is a loop of material attached to the handle. The loose end of the strap is then placed through the slot, and may remain through the slot, in the wide section of the strap and positioned so as to abut the top side of the handle. The device further includes a spike driven into the bottom side of the handle with one end of the spike protruding the top side of the handle. The strap is formed into a loop, so that for each time of use, the loop may be readjusted to the size of the lid to be loosened or tightened and positioned with the protruding end of the spike extending through one of a series of holes in the strap. The series of holes in the strap extending longitudinally all the length of the narrow section of the strap allows the device to be used with a wide range of lid diameter sizes, by resetting the loop to fit snugly about the lid.

Rotation of the handle in a counter-clockwise direction about the center of the lid will apply torque to the lid and loosen the lid on the jar or container. A mechanical advantage is obtained which is proportional to the difference in length between the radius of the lid and the distance between the the center of the lid and the point at with the handle is grasped for application of the counter-clockwise force to the handle. An additional mechanical advantage is obtained when the handle is rotated by the distance between the edge of the bottom of the handle in contact with the lid which serves as a fulcrum and the part of the brace in contact with the strap. Therefore considerably less force is required to loosen the lid using the device than the force required to loosen the lid if the force were applied directly to the outer rim of the lid.

The lid may be tightened by turning the device over, i.e. with the top side of the device toward the user rather than away from the user, and rotating the handle in the clockwise direction rather than the counter-clockwise direction. The device also provides a mechanical advantage as described above when used as a tightener. Thus a given force applied to the handle will tighten the lid to a much greater extent than the same force applied directly to the lid.

A single device can be used in two ways. The strap may applied to the lid and the jar held or the strap may be wrapped around the jar and the lid held while loosening or tightening. For persons with arthritic hands who cannot grasp either the lid or the jar, two devices may be used. The strap of one device is placed about the lid for the application of a force to the lid while the strap of the second device is positioned about the container or jar to apply an opposing force to the jar or container. Ths the lid may be loosened or tightened by pushing against the handles of the devices without the necessity of grasping the handles, the lid or the jar.

DESCRIPTION OF THE DRAWING

Other objects and many of the attendant advantages of this invention will be readily appreciated as the same becomes better understood by reference to the following description when considered in connection with the accompanaying drawing wherein.

DETAILED DESCRIPTION OF THE PREFFERED EMBODIMENT

Figure 1:
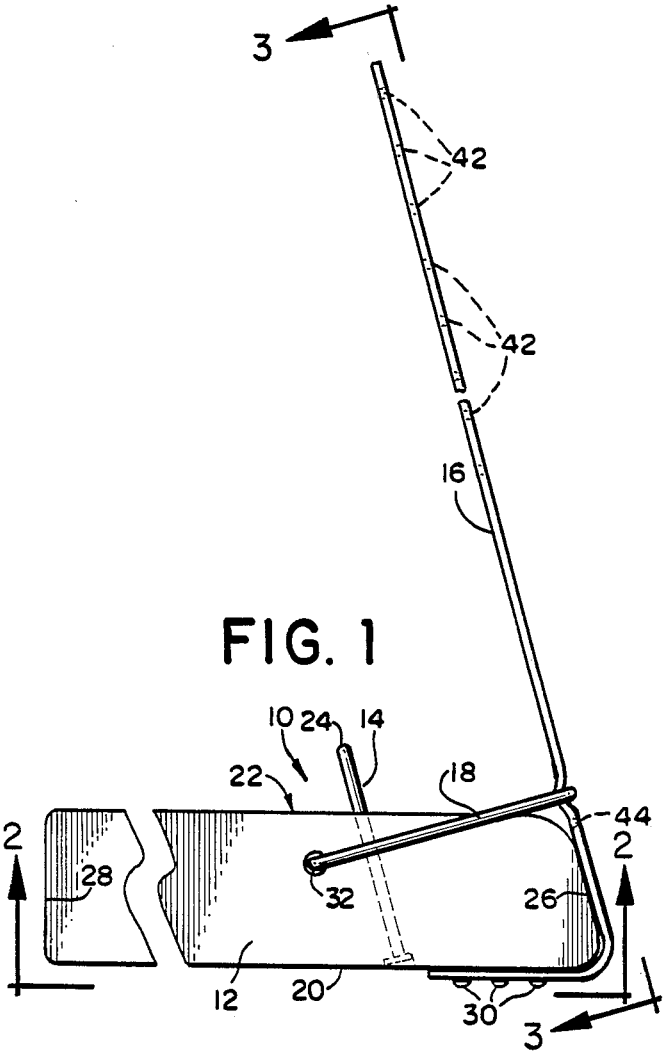
FIG. 1 is a top plan view of the device with the strap extended.

Referring now in greater detail to the various figures of the drawing wherein like reference characters refer to like parts, there is shown in FIG. 1 device 10 constucted in accordance with the instant invention. Device 10 comprises a handle 12, a spike 14, a strap 16, and a brace 18. The spike 14 is driven through the bottom 20 of the handle 12 and protrudes through the top 22 of the handle 12. Tip 24 of the spike 14 is flattened and smoothed for safety purposes.

As can be seen in FIG. 1 the spike 14 is angled away from the near end 26 of the handle 12 and toward the distal end 28 of the handle 12 to better secure the strap 16 after it has been wrapped around the lid of a jar or container, as will be explained in detail later.

Figure 2:
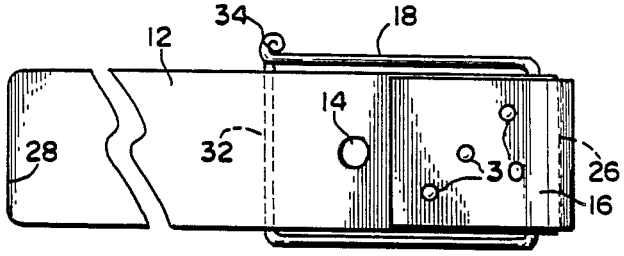
FIG. 2 is a side elevation view of the device taken along the line 2—2 of FIG. 1.

The strap 16 is secured to the bottom 20 by the screws or tacks 30 and placed through the brace 18. Brace 18 forms a loop placed through the the hole 32 of the handle 12, as shown in FIGS. 1 and 2. FIG. 2 is a side elevation view of the device 10. The ends 34 of the brace 18 are tied together to form the loop.

Figure 3:
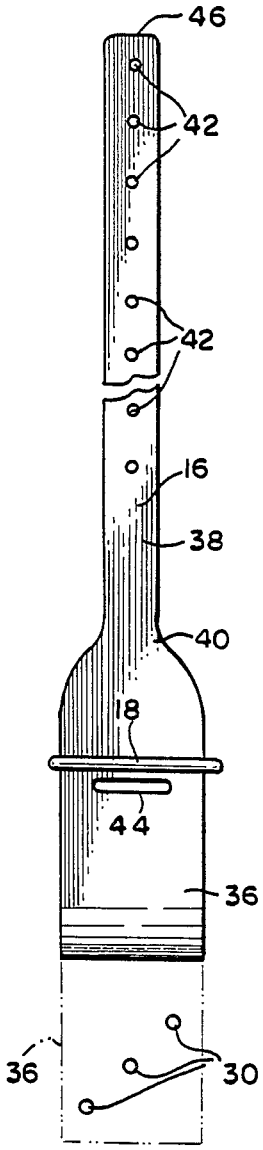
FIG. 3 is a view of the strap of the device taken along the line 3—3 of FIG. 1.

FIG. 3 is a plane view of strap 16 taken along the line 3-3 of FIG. 1. As can be seen in FIG. 3, the strap comprises a wide section 36 and a narrow section 38. Shown in dashed outline is the remainder of the wide section 36 which abuts the bottom 20 of the handle 12 and is attached thereto with the tacks 30. The wide section 36 is tapered down to form the narrow section 38 at the neck 40.

The narrow section 38 contains uniformely and closely spaced holes 42 through which the tip 24 will protrude to secure the strap 16 after the strap 16 has been placed around a lid, as will be explained later. As can be seen in FIGS. 1–3 the strap 16 is fed and generally left through the loop of the brace 18. The wide section 36 has a slot 44 placed below the junction of the brace 18 and the wide section 36 so that the end 46 of the narrow section 38 may be inserted through the slot 44 to form a loop of the narrow secton 38 which has been placed around lid 48, as shown in FIG. 4.

Figure 4:
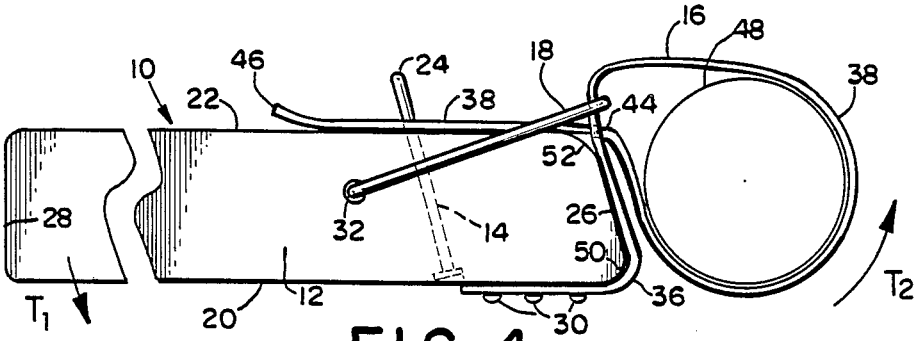
FIG. 4 is a top plan view of the device with the strap secured around the lid of a jar or container for loosening the lid.

FIG. 4 is a top plan view of the device 10 with the strap 16 placed round the lid 48 and secured by the spike 14 for loosening the lid 48 of a jar or container. For loosening, the handle 12 is positioned with the top 22 and the tip 24 of the spike 14 away from the user so that the lower edge 50 of the near end 26 is positioned counter-clockwise, looking down at the lid of the jar, relative to the center of the lid 48, from upper edge 52 of near end 26.

To loosen the lid 48 of the jar or container (not shown), the strap 16 is inserted through the brace 18 and a loop is formed by placing the end 46 through slot 44 forming a loop which is placed around the lid 48. The end 46 of the narrow section 38 is then threaded through the slot 44 in the wide section 36 and placed abutting the top 22 of handle 12. The strap 16 is secured to the handle 12 by allowing tip 24 to protrude through one of the holes 42 as shown in FIG. 4.

The lid 48 is loosened by the application of a counter-clockwise force T1, relative to the center of the lid 48 when looking down on the lid, to the handle 12 as shown in FIG. 4. The force T1 causes the lower edge 50 of near end 26 to press against the lid 48 and to rotate handle 12 about the bottom edge 50. The lower edge 50 thus acts as a pivot for the handle 12 and causes the brace 18 to pull on the strap 16 thus applying a counter-clockwise force T2 to the lid 48. The force T2 loosens the lid 48. As mentioned previously device 10 provides a mechanical advantage so that the force T1 will create the larger force T2 which is applied to the lid 48.

As described previously the lid 48 may be tightened by positioning the handle 12 so that the top 22 is facing the user (not shown), i.e. the positions of the top 22 and the bottom 20 are reversed to that shown in FIGS. 1 and 2, and applying a clockwise force to the handle 12.

Figure 5:
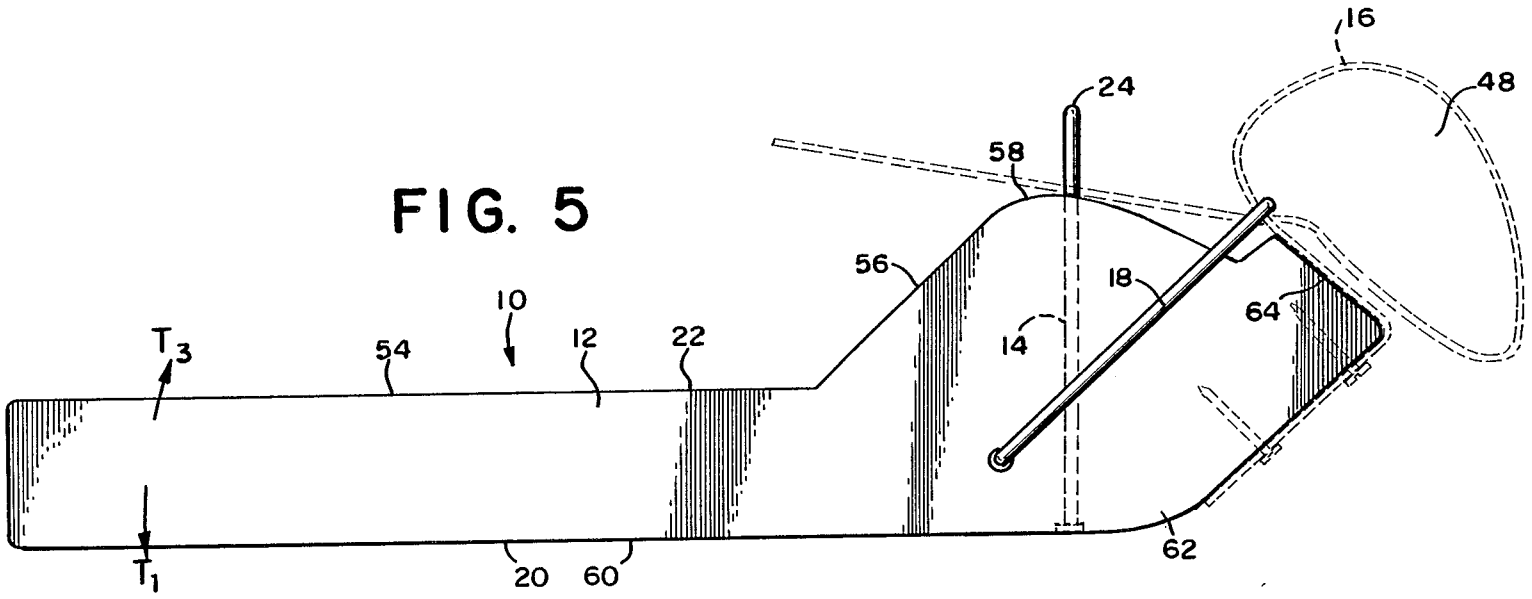
FIG. 5 is a top plan view of an alternative embodiment of the device.

An alternative embodiment of the instant invention is shown in FIG. 5, with the strap 16 (shown dashed) placed around the lid 48, arranged for loosening the lid 48. The force T1 applied counter-clockwise about the center of the lid 48 will loosen the lid 48. As previously explained, with devise 10 turned over, i.e. the positioning of the top 22 and the bottom 20 reversed, and the strap 16 wrapped counter-clockwise around the lid 48, a clockwise force T3 would tighten the lid 48.

As seen in FIG. 5, in the alternative embodiment, the top 22 of the handle 12 comprises a straight section 54 and a curved section 56. The curved section 56 has a flattened section 58 through which the end 24 of the spike 14 protrudes. As in the case in the previous embodiment, the strap 16 is first passed through the the brace 18 and passed through the slot 44 and secured by passing the tip 24 through one of the holes 42 in strap 16. The loop thus formed in the strap is placed about the lid 48 (not shown).

It should be noted that in the alternative embodiment, the spike 14 is approximately perpendicular to the straight section 60 of the bottom 20, rather than angled toward the distal end 28 as in the previous embodiment shown in FIGS. 1 and 4. Thus the strap 16 is more nearly perpendicular to the spike 14 in the embodiment of FIG. 5 than in the previous embodiment and when counter-clockwise force T1 is applied to the handle 12 to loosen the lid 48, not only does brace 18 apply force to the strap 16 to loosen lid 48, but spike 14 applies force to the strap as well.

Although the description thus far has described the loosening and tightening of lids by placing the strap 16 around the lid 48 and applying force to the handle 12 while holding the jar or container with the other hand, the device 10 could just as well be used by wrapping the strap 16 around the jar or container and holding the lid. The latter method would be used when the jar or container is larvge and difficult to hold.

Figure 7:
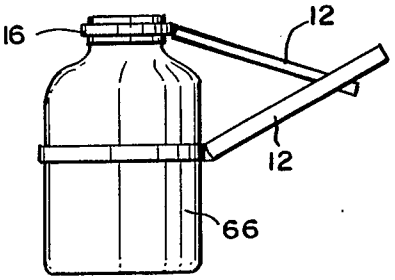
FIG. 7 is a side elevation view showing the use of two devices to loosen or tighten lids.
Figure 6:
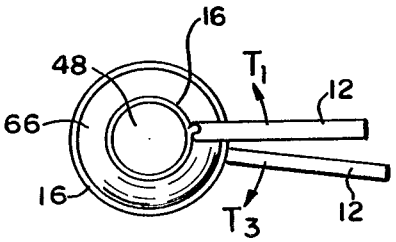
FIG. 6 is a top plan view showing the use of two devices to loosen or tighten lids, one with strap wrapped around the jar or container and the other with strap wrapped around the lid.

FIGS. 6 and 7 illustrate the use of two devices for loosening and tightening lids in cases where the user due to infirmity cannot grasp the handle, lid or jar. The lids may be loosened or tightened by pushing against the handles 12.

FIG. 6 is a top plan view showing two devices 10, one with its strap 16 around the lid 48 and the other with its strap 16 around the jar 66. A counter-clockwise force T1 is applied to the lid 48 while a clockwise force T3 is applied to the jar 66 to loosen the lid 48. FIG. 7 is a side elevation view of the use of two devices 10 to loosen or tighten lids.

Typical dimensions for the embodiment of FIGS. 1, 3 and 4 are: width and thickness of the handle 12 approximately one inch; length of the handle 12 approximately nine inches; and length of the strap 16 approximately 21 inches for lids up to five inches in diameter. Of course, the length of the strap 16 may be increased as appropriate for larger lids, jars or containers.

For the alternative embodiment as shown in FIG. 5, typical dimensions for the device 10 may be: the straight section 54 of the top 22 approximately five and one quarter inches; the straight section 60 of the bottom 20 aproximately six and one half inches; the height of the curved section 56 above the straight section 54 approximately one and one quarter inches; the width and thicknesss of the handle 12 and the end section 64 approximately one inch; and the length of the spike 14 approximately three inches.

Suitable materials for the handle 12 may be wood, plastic or mettalic for either embodiment. Suitable materials for the strap 16 may be leather, plastic or a flexible metallic. The inside surface of the strap should be rough to provide proper gripping for small diameter lids.

Without further elaboration, the foregoing will so fully illustrate my invention that others may, by applying current or future knowledge, readily adapt the same for use under various conditions of service.

I claim:

1. A device for loosening and tightening the lids of jars or containers, said device comprising a handle, a flexible strap, a means for attaching said strap to said handle, a means for forming a loop in said strap sized to be placed around said lid, a means for securing said strap to said handle after said strap has been wrapped around said lid, said handle comprising a top and a bottom, said strap comprising a wide section and a narrow section, said means for attaching said strap to said handle comprising tacks wich attach said wide section to said bottom of said handle, said means for forming said loop comprising a brace attached to said handle and a slot positioned in said wide section, and said strap further comprising an unattached end so that said loop may be formed by placing said unattached end through said brace and inserting said unattached end through said slot.

2. The device of claim 1 wherein said means for securing said strap to said handle comprises a series of holes in said narrow section of said strap positioned longitudinally along the length of said strap and a spike driven through the bottom of said handle, said spike having a tip protruding through said top of said handle, so that when said strap is wrapped around said lid and threaded through said slot and pulled tight, said strap is secured to said handle by positioning said strap so that said tip protrudes through one of said holes.

3. The device of claim 2 wherein said handle further comprises a near end and a distal end and said spike is angled away from said near end and toward said distal end.

4. The device of claim 3 wherein said near end comprises an upper edge adjacent said top and a lower edge adjacent said bottom, and wherein said near end is angled from said lower edge to said upper edge back toward said distal end, with said bottom and said near end forming an acute angle at their junction and said top and said near end forming an obtuse angle at their junctions.

5. The device of claim 2 wherein said top comprises a straight section and an upwardly projecting curved section, said curved section having a flattened section, said spike being driven through said bottom at an angle of about ninety degrees with respect to said bottom with the tip of said spike projecting through said flattened section.

6. A system for tightening and loosening the lids on jars or containers, said system comprising a first and a second device, each of said devices comprising a handle, a flexible strap, a means for attaching said strap to said handle, a means for forming a loop in said strap sized to fit around said lid and said jar or container, a means for securing said strap to said handle, said handle comprising a top and a bottom, said strap comprising a wide section and a narrow section, said means for attaching said strap to said handle comprising tacks which attach said wide section said bottom of said handle, said means for forming said loop comprising a brace attached to said handle, and a slot positioned in said wide section, said strap further comprising an unattached end so that said loop may be formed by placing said unattached end through said brace, and inserting said unattached end through said slot, so that when said strap of said first device is placed around said lid and when said strap of said second device is placed around said jar or container and opposite forces are applied to the handle of each of said devices said lid may be loosened or tightened.

* * * * *